US012618204B2

(12) United States Patent
Roden et al.

(10) Patent No.: US 12,618,204 B2
(45) Date of Patent: May 5, 2026

(54) ASPHALT PAVING DEVICE

(71) Applicants: Thomas V. Roden, Port Washington, WI (US); Sid R. Prom, Cedarburg, WI (US)

(72) Inventors: Thomas V. Roden, Port Washington, WI (US); Sid R. Prom, Cedarburg, WI (US)

( * ) Notice: Subject to any disclaimer, the term of this patent is extended or adjusted under 35 U.S.C. 154(b) by 662 days.

(21) Appl. No.: 18/080,357

(22) Filed: Dec. 13, 2022

(65) Prior Publication Data

US 2023/0304234 A1 Sep. 28, 2023

Related U.S. Application Data

(60) Provisional application No. 63/323,598, filed on Mar. 25, 2022.

(51) Int. Cl.
*E01C 23/06* (2006.01)

(52) U.S. Cl.
CPC ..... *E01C 23/065* (2013.01)

(58) Field of Classification Search
CPC ..... E01C 23/0635
USPC ..... 404/77, 79, 91, 95
See application file for complete search history.

(56) References Cited

U.S. PATENT DOCUMENTS 4,272,212 A * 6/1981 Bauer, Jr. ..... E01C 19/1045 366/12
5,484,224 A * 1/1996 Lynch ..... E01C 23/065 404/77
6,769,836 B2 * 8/2004 Lloyd ..... E01C 23/065 404/91
8,033,641 B2 * 10/2011 Hilmersson ..... B28D 1/00 404/91
2010/0104363 A1 * 4/2010 Benedetti ..... E01C 23/065 404/113
2010/0209188 A1 * 8/2010 Wiley ..... E01C 23/065 404/77
2010/0296867 A1 * 11/2010 Buschmann ..... E01C 19/48 404/108
2011/0091276 A1 * 4/2011 Hall ..... E01C 23/065 299/39.4
2014/0119829 A1 * 5/2014 Eliot ..... E01C 23/065 404/113
2014/0270953 A1 * 9/2014 Duffy ..... E01C 19/05 404/91

* cited by examiner

*Primary Examiner* — Raymond W Addie
(74) *Attorney, Agent, or Firm* — Mandy L. Tran; CERES Patent & Technology, LLC

(57) ABSTRACT

The invention disclosed herein pertains to a device for repaving an existing asphalt surface, specifically a road surface. The device enables continuous uninterrupted excavation and removal of old road paving material. Said device further extracts the excavated material for milling into smaller evenly sized aggregate material that is sorted through by size, retreated under heated conditions with the addition of hot oil, and further homogenized for even size, density, and saturation before being relayed over the extracted surface.

1 Claim, 4 Drawing Sheets

ASPHALT PAVING DEVICE

CROSS REFERENCE TO RELATED APPLICATIONS

Figure 1:
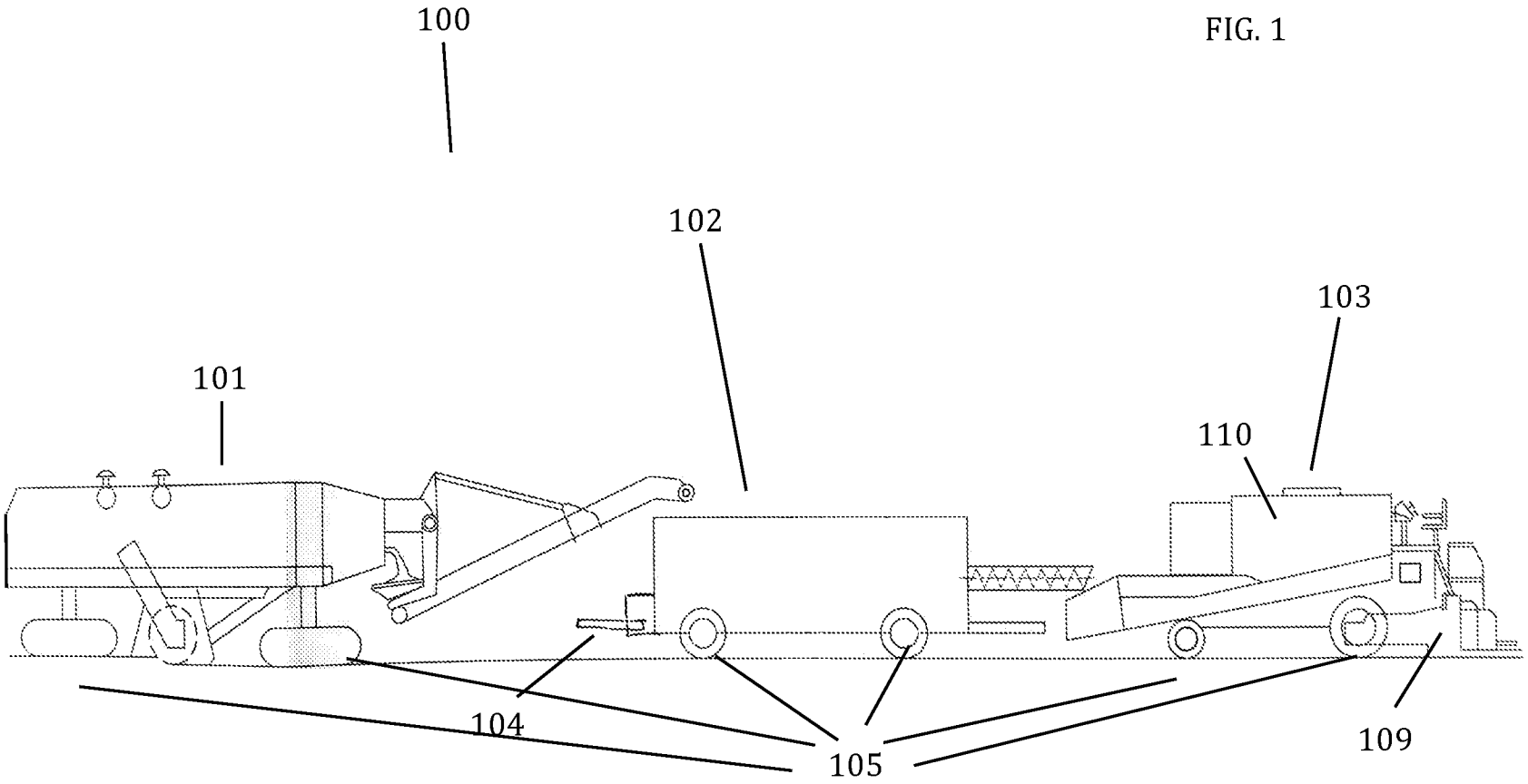

This is a nonprovisional patent application claiming priority benefit of U.S. Provisional Patent Application No. 63/323,598, filed on Mar. 25, 2022, in accordance with 35 U.S.C. 119(e). Provisional patent application No. 63/323,598 is hereby incorporated by reference in its entirety.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

Field of the Invention

The invention herein pertains to a device for repaving an asphalt ground surface.

Background

Advancement of technology relating to the rehabilitation of roads now allows for on-sight removal, rehabilitation, and reuse of aged asphalt pavement material. Current types of asphalt material used for road rehabilitation comprise the following: Hot Asphalt, MC Cold Asphalt, and UPM. The inherent nature of these types of asphalt material will determine paving methods. Hot Asphalt is a common type of asphalt used for paving and patching. As the name suggests, Hot Asphalt, is easiest to work with when the temperature of the asphalt is high. Hot Asphalt is longer lasting and offers permanent solution to road condition problems. However, it must be used almost immediately after purchasing. As the asphalt cools, it becomes increasingly difficult to work with, and once completely cool, it hardens like rock. MC Cold Mix is asphalt that can be used as a temporary solution. Since this type of asphalt is used at cold temperatures, it is slow to cure and best used in areas that have little to no traffic to avoid deformities from untimely impact. UPM is also a cold mix asphalt, but unlike MC Cold Mix, it can be used as a permanent solution to any asphalt or concrete problem. UPM is designed to work in any weather condition and can be used to fix both wet and dry holes. Once UPM has been compacted, it is immediately ready to be tread upon.

The focus of this invention relates to on-site recycling and reuse of hot asphalt material. U.S. Pat. No. 4,534,674 relates to a method and system for recycling and reuse of hot asphalt pavement material. U.S. Pat. No. 4,534,674 discloses a road resurfacing machine comprising a vehicle having a heating element positioned underneath a chassis wherein said heating element directly heats and melts the road surface. The melted state of the road surface renders it more malleable for scarification. By this invention, the road is excavated and crushed on-site to produce coarse rubble, hot asphalt cut-back oil is sprayed directly onto the coarse rubble to rehabilitate and bind the asphalt, new hot asphalt material is added atop the excavated rehabilitated material and mixed in commingling manner in-situ, then compacted by said vehicle. A problem remains whereby the device lacks the ability to homogenize the size, the density distribution, and the evenness of coated oil over the excavated aggregate material, which affects the life-span of the pavement. U.S. Pat. No. 12,734,584 discloses a similar method of in-situ hot asphalt resurfacing that also lacks a means to homogenize the excavated material. There currently remains a need within the industry for improved quality of recycled hot-asphalt material for in-place repair wherein the rehabilitated asphalt material is more homogeneous in size, distribution, and saturation.

SUMMARY OF THE INVENTION

The invention disclosed herein pertains to a device for repaving an existing asphalt surface, specifically a road surface. The device enables continuous uninterrupted excavation and removal of old road paving material. Said device further extracts the excavated material for milling into smaller evenly sized aggregate material that is sorted through by size, retreated under heated conditions with the addition of hot oil, and further homogenized for even size, density, and saturation before being relayed over the extracted surface.

It is an objective of this invention for the device of this invention comprises a series of interconnected wheeled carriages that are connected by a single motorized engine.

It is another objective of this invention for the device to comprise a series of interconnected wheeled carriages move tandemly together in a linear direction.

It is another objective of this invention that the device enables milling of excavated asphalt material into relatively similar-sized stones, and for the mixture of said milled stones to be evenly coated with hot oil, and to be mixed into a relatively homogenous texture and or density.

It is yet another objective of this invention to offer a device that enables the excavation, recycling, rehabilitation and re-use of old surface asphalt all within containment of said device, in an on-site manner, and for immediate on-site use.

In order to facilitate an understanding of this invention, the preferred embodiments of the invention are illustrated in the drawings, and a detailed description thereof follows. Other features, advantages, and object of the present invention will become more apparent and be more readily understood from the following detailed description, which should be read in conjunction with the accompanying drawings. It is not intended, however, that the invention be limited to the particular embodiments described or illustrated herein. Various modifications and alternative embodiments such as would ordinarily occur to one skilled in the art to which the invention relates are also contemplated and included within the scope of the invention described and claimed herein.

BRIEF DESCRIPTIONS OF DRAWINGS

FIG. 1 provides an illustrative example of a preferred embodiment of the invention as described herein.

Figure 2:
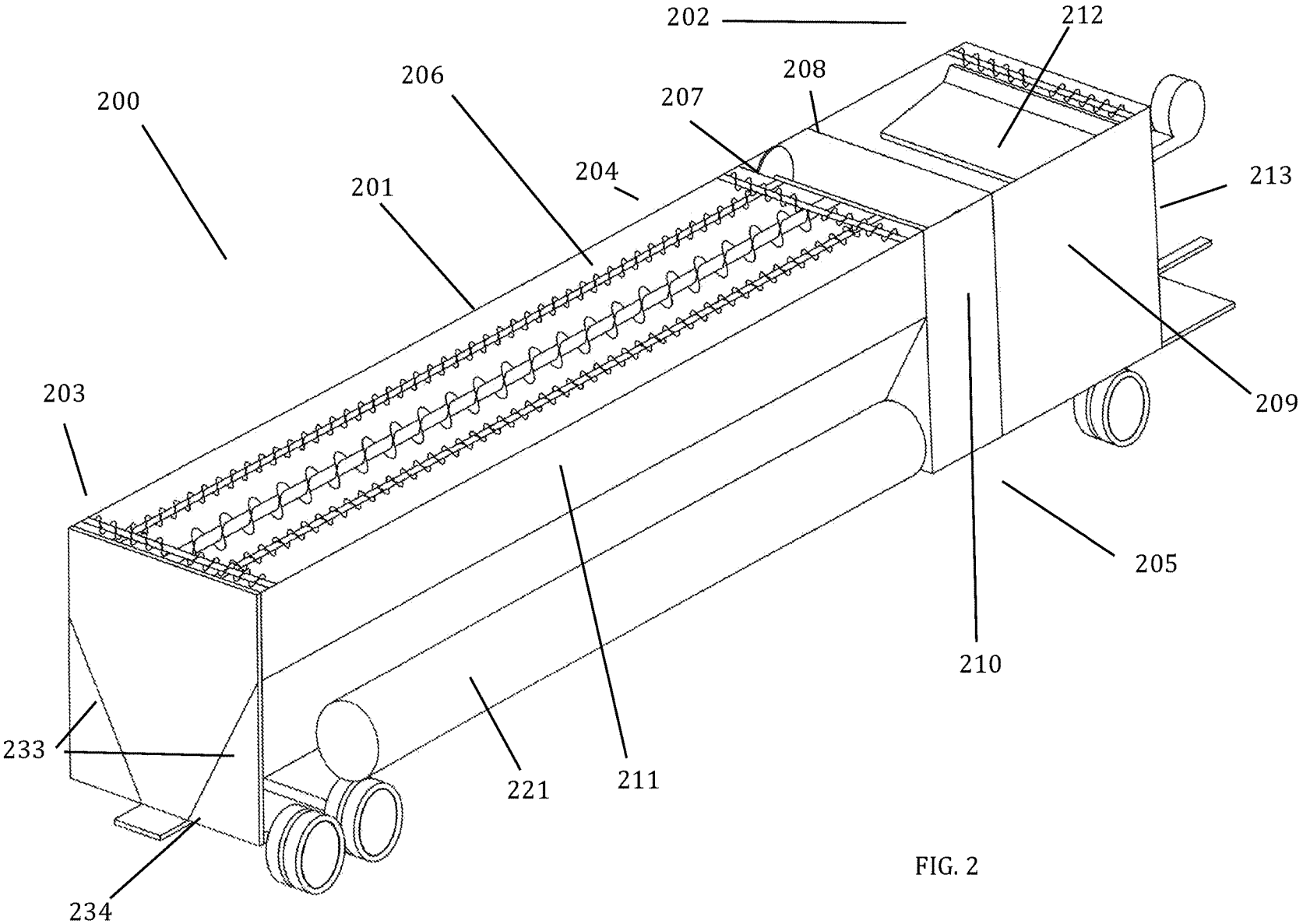

FIG. 2 provides a top-view illustrative example of a preferred embodiment of the second carriage device of this invention as described herein.

Figure 3:
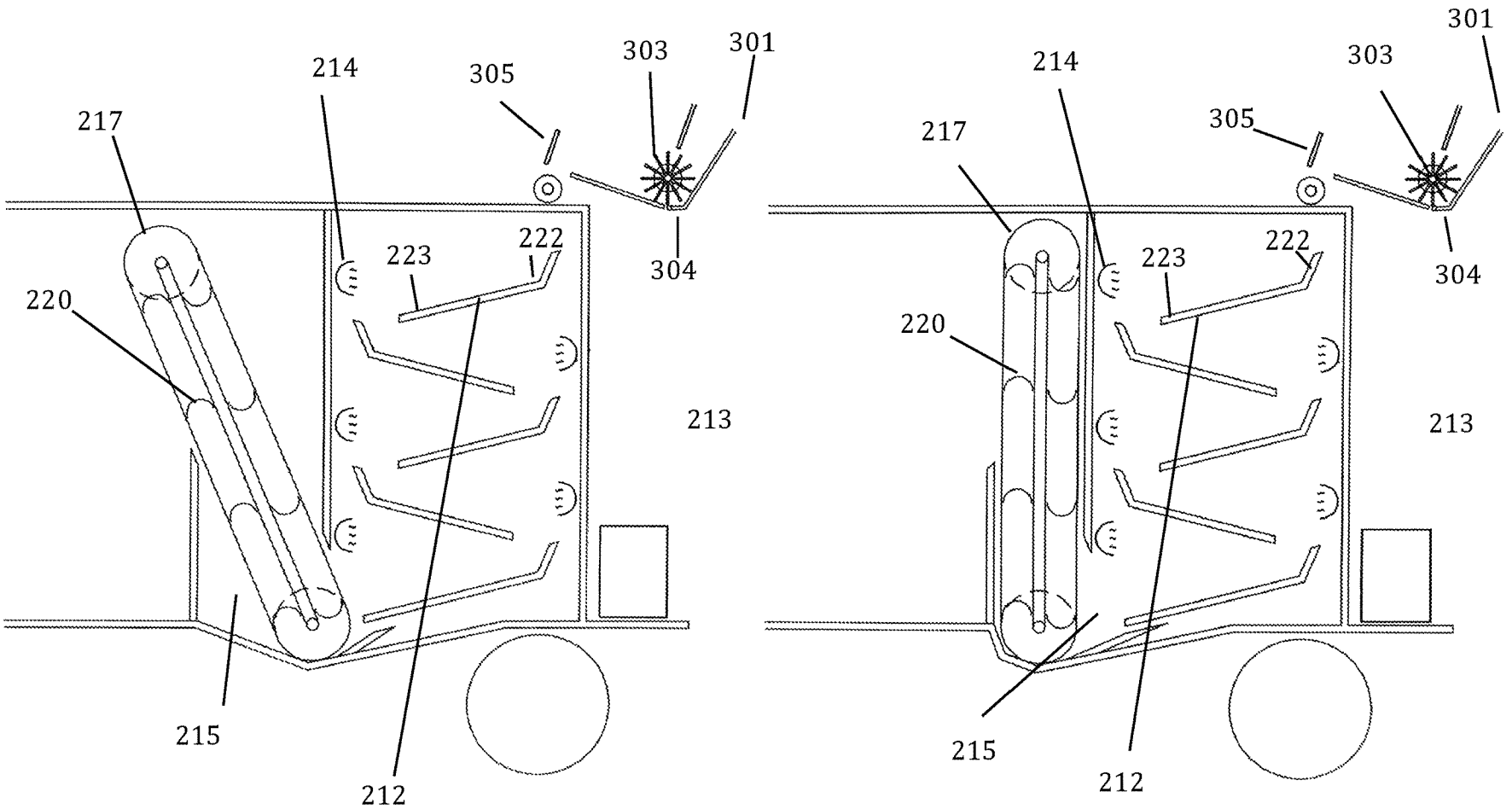

FIG. 3 provides a cross-sectional side view of a preferred embodiment of the second carriage device of this invention, specifically showing its internal components.

Figure 4:
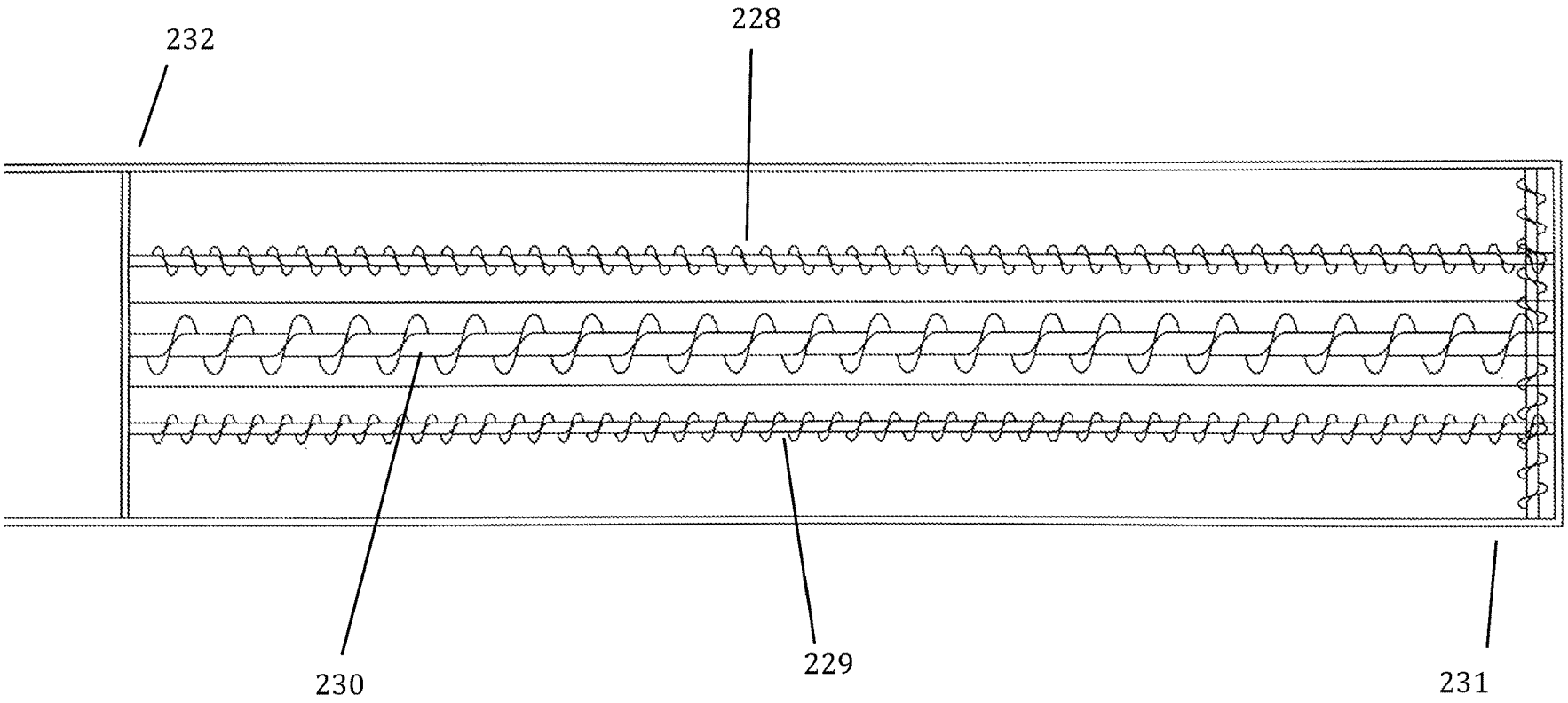

FIG. 4 provides a top-view illustrative example of a preferred embodiment of the second carriage device of this invention, specifically showing its internal components.

DETAILED DESCRIPTION OF THE INVENTION

Reference will now be made in detail to exemplary aspects of the present invention which are illustrated in the accompanying drawings. Wherever possible, the same reference numbers will be used throughout the drawings to refer to the same or like parts.

A first embodiment of said device 100 as shown in FIG. 1 comprising at least three separate carriages 101, 102, 103 that move in tandem with each other, preferably in coordinated time, space, or speed with each other. Each said three separate carriages preferably contain elements that enable four-wheel steering. Each said at least three separate carriages having at least three types of carriages 101, 102, 103. Each type of carriage serving a different type of function. Each said carriage is coordinated with the other to enable continuous in-place processing of asphalt material. Each said carriage may be interconnected by manner of a tow bar 104 or similar tool where a forwardly positioned carriage would pull the rearwardly positioned carriage as the entire device is moved forward by manner of said single motor-driven engine element held within the front cab of the first front carriage 101. Alternatively, each carriage may be independently motor-driven, self-navigable, and not physically connected to another carriage of the device. According to this alternative embodiment, each carriage may move tandemly with the other carriages but at its own separate independent speed and schedule of movement to accomplish the same or similar affect.

Each of said three types of vehicular carriages have a chassis attached to wheels 105 below and a large bucket container positioned above. The large bucket or container 201 of each said vehicular carriage 200 as shown in FIG. 2 having a front end 202 and a rear end 203, a left side 204 and right side 205. Said large bucket or container of each vehicular carriage as shown in FIG. 2 having a top side 206 that is preferably open or alternatively partially closed. Said top side 206 may alternatively have a removable top cover to contain dust particles. In either case, the top side 206 of said large bucket or container of each vehicular carriage is able to receive excavated asphalt material wherein said excavated asphalt material is transferred from either the ground surface or from the bucket or container of an adjacently positioned vehicular carriage. The top side of said large bucket or container of each vehicular carriage is further able to transfer asphalt material contained within towards and into a large bucket or container of a forwardly positioned and adjacent vehicular carriage.

A preferred embodiment of this device as shown in FIG. 1 comprises three types of vehicular carriages, each type of vehicular carriage accomplishing a certain type of work, and each of said three types of vehicular carriages feeding material into the other along a linear path. Said first type of vehicular carriage 101 comprising an excavation machine that pulverizes and loosens asphalt on a road surface. This first type of vehicular carriage may be referred to interchangeably as the extraction carriage 101. More than one extraction carriage may be linked together in a single device unit. Two or more of such extraction carriages may be adjacently positioned or linked together in sequence. Said first vehicular carriage having an extraction element 109 whereby the pulverized and loosened asphalt material from said ground surface is pulled into the large container or bucket of said first vehicular carriage by a scraping, sweeping, or vacuuming tool, or a combination of any of these tools. Said large bucket or container 110 of said first carriage 101 further containing a milling tool whereby the extracted asphalt material is milled to evenly and smaller sized stones. Said milling tool of said first vehicular carriage may comprise a single rotating cylinder drum or two counter-rotating grinding drums or wheels. Either of said drums or wheels having a rough or ridged external surface that will engage with and grind down said extracted asphalt material. Internal to the front end of the large bucket or container 110 of said first vehicular carriage 101 is an elevator system that is angled in an upward position towards the top side of said first end of said first vehicular carriage. As further shown in FIG. 3, a linear platform extends from the top end of said elevator system, creating a near L-shaped feature 301. See FIG. 3. One or more rotatable drum 303 is located above the elevator system, near or adjacently above the elbow portion 304 of the L-shaped. Said one or more rotating drum 303 is rotatable in a forwardly manner to push or throw the milled extracted asphalt material forward into the large bucket or container of a second type of vehicular carriage. Said one or more rotatable drum is preferably sleeved through a central rotatable axle shaft. Said one or more rotatable drum is preferably 24 inches wide in diameter. The external surface of said one or more rotatable drum having a series of variable sized spikes or teeth extending therefrom to aid in the milling of said reclaimed asphalt material. Vertical guard elements 305 may be positioned in front of said single rotating drum to direct the expelled milled material downward towards a desired location.

Said second type of vehicular carriage 200 as shown in FIG. 2 comprising also a large bucket or container 201 attached above a chassis element. The container of this type of vehicular carriage is internally segmented across the cross-section of its width by two dividing walls 207, 208 to create three segmented spaces. The first 209 and second 210 segmented spaces are located forward of said container and a third segmented space 211 is located rearward of said container. Said first and second segmented spaces are heated chambers. Said first segmented space 209 having a plurality of shaking elements 212 (also referred to as pans) protruding inward from opposing walls 208, 213. Said first segmented 209 (also shown in FIG. 3) space further having a plurality of spraying elements 214 that spray hot oil therein. Said second segmented space 210 sharing a wall 208 in common with said first segmented space 209. An open space 215 is located at the bottom side of said shared wall 208 between said first 209 and second 210 segmented space such that material may be passed through therebetween. Said second segmented space 210 further containing an elevator-style lift 217. Said elevator style-lift 217 comprising either a conveyor (chain or belt element) or auger element that is rotatable around at least one motor-driven rotating element. Said elevator style-lift 217 is removably attached to a plurality of scooping container elements 220 that each scoop, contain, and carry material therein upward towards the top of the container of said second carriage. Said third segmented space 211 is a heated chamber with a mixing element.

The nature of this second type of vehicular carriage 200 is to heat treat and homogenize the milled material. This second type of vehicular carriage may be referred to interchangeably as the heating carriage. At either side along the bottom length of said heating carriage is either a container 221 that holds and dispenses hot oil through said plurality spraying elements or a container that holds engine fuel to maintain the movement and operation of the device itself. Said device of this invention may have more than one heating carriage connected thereto. The material in a heated state contained within the first segmented space is pushed through the open space 215 between the shared wall 208 of said first and second segmented spaces and moved by a conveyor 218 (chain or belt element) or auger system or a combination of both in an upward manner towards the top and over into said third segmented space 211 where the heated material is further mixed to a desired homogenous texture and or density. An engine is positionable at either forward or rearward ends of said heating carriage to power the internal mechanisms therein. Said second carriage preferably has four-wheel steering capabilities.

Said first segmented space 209 of said second carriage 200 as shown in FIG. 3 provides a series of pans 212, each pan positioned at a downward sloping angle. Each pan having a first terminal end 222 attached to a side wall of said container of said heating carriage and a second terminal end 223 that terminates in a floating non-attached manner. An open space 224 exists between the second terminal end of each pan and a side wall of said container that is opposing to the first terminal end of each said pan. A plurality of pans 212 are positioned adjacently above or below each other such that said series of pans are positioned in a stepped manner along a vertical axis. The first terminal end 222 of each pan is positioned at a higher plane than its each said second terminal end 223 such that the first terminal end is always downward sloping towards its said second terminal end. Said first terminal end 222 of a first pan is positioned oppositely from the first terminal end 222 of a subsequent adjacent pan such that the position of each first terminal end rotates between each subsequent pan of said series of pans. The effect of this is a continuously downward sloping effect in zig-zag manner between the farthest top pan to the lowest bottom pan wherein the center space is open throughout. This allows the milled stones to loosely fall downward through the open center space between the series of pans. Each pan 212 is attached to a shaking mechanism which causes each pan to agitate. Agitation of each pan will help to disperse the milled stones and allow them to separately fall by the effect of gravity and weight. Heavier stones will fall and be located at the bottom of said container ahead of smaller stones. Spraying mechanisms 214 are further located along the side walls of said first segmented space, spraying hot oil onto the milled stones as they are being shaken and separated therein. The agitation of the milled stones helps to evenly coat and saturate each stone individually. A heating element is positioned directly underneath each linear pan to keep each pan in a heated state. The shaking motion of each said linear pan together with being in a heated state will progressively heat the granular asphalt material into a heated malleable state while moving said granular asphalt material towards the next phase of the reclamation and recycling process.

An escalator element 217 is positioned within a second segmented space 210 of said heated carriage. Said escalator element 217 comprising a conveyor device which may be an auger or a vertically rotating belt or chain element attached to a plurality of smaller scooping containers or buckets 220. Said escalator element 217 rotates upward towards the third segmented space 211 such that each smaller bucket 220 of said plurality of smaller buckets will scoop the milled and saturated stones passing through the bottom open space 215 between said first 209 and second 210 segmented space, carry said material upward and dispense said material over and into said third segmented space 211. Note that the first 209 and second 210 segmented spaces are heated spaces where the stones are kept in heated malleable form.

A rotatable grinding device or breaker wheel 303 is positioned forward from and adjacently to the front end of said first segmented space 209. Said grinding device 303 is preferably positioned along the top side of said front end of said first segmented space. Said grinding device pulls material from said excavation carriage 100, further milling the material down into smaller evenly sized stones. Said grinding device 303 may alternatively serve the function of moving said stones from said excavation carriage into the first segmented space 209 of said second carriage 200. It is an objective of this invention to mill or grind the extracted asphalt material to a defined minimum and maximum size range to achieve proper compaction on the ground surface according to regulatory and industry standards.

The milled stones enter from said extraction carriage 100 into said heating carriage 200 at its first segmented space 209. Within said first segmented space 209 and throughout the internal spaces of said heated carriage 200, the milled stones are heated to an ideal temperature to soften the reclaimed asphalt to a malleable state. Each said pan 212 of said plurality of pans within said first segmented space may further be heated by a heating element. The heated material is held and agitated by said pans within said first segmented space to help loosen the material for further homogenizing treatment. The agitation further having the effect of moving the material downward towards the bottom end of said heating carriage.

Said third segmented space 211 of said heating carriage 200 containing at least three augers 228, 229, 230 for purposes of mixing and homogenizing said heated and oil-treated milled stones. Said at least three augers 228, 229, 230 comprising at least two or more narrow-diameter augers 228, 229 positioned above a wider-diameter single auger 230 located centrally below. Each said auger of said three or more augers extending along and parallel with the length of said third segmented space 211 and parallel with each other. Each said auger of said two narrow-diameter augers 228, 229 are connected to a motor drive that drives movement of material mixed therebetween in a direction towards the rear end 231 of said heating carriage. Said material is mixed between the dual auger system of said two narrow-diameter augers 228, 229. Said material is then pulled downward by said larger-diameter auger and moved toward the forward end 232 of said third segmented space. Upon reaching the forward end of said larger-diameter auger, the material is pushed downward and rearward towards the rear end 231 of said third segmented space 210. Note a preferred embodiment of bottom side 233 of said third segmented space is either V-shaped or U-shaped (by its cross-sectional shape) 233 to enable a downward funnel effect of the milled and oil-treated material as it is being mixed.

The walls of said heating element is comprised of fireproof material. Externally at either sides of said V or U-shaped sides 233 of said third segmented space 211 are attached either a propane gas tank or an oil tank 221. Alternatively, the tanks 221 may comprise chambers created by additional fire-proof material surrounding the external angular V or U-shaped side walls. Oil that is used for homogenizing said reclaimed asphalt is contained within one of said two hollow fire-proof chambers. Propane gas is contained within the other hollow fire-proof chambers or tanks 221. Said propane gas is used to heat the reclaimed asphalt material. Oil is sprayed onto the heated material within the first 209 and third segmented space 211 to rehabilitate the aged asphalt material. The finished blended material is moved by the auger towards an opening at the rear end of said heating carriage. Said material may be released through said opening 234 and moved by conveyor platform towards another location such as a third-type of vehicular carriage 103 for immediate paving or into a temporary storage container.

Said third-type vehicular carriage 103 having a chassis attached to a container element above, said container element having a closable port at its bottom side, and a heavy roller element 400 below. Said third-type of vehicular carriage 103 may be interchangeably referred to as a paving carriage 103. Said paving carriage serves the purpose of containing the homogenized material, dispensing said homogenized material onto the ground surface below, and creating pavement by compacting said homogenized material with said heavy roller element.

A preferred embodiment of each said pan of said plurality of pans within said first segmented space of said heating carriage is removably attachable to the side walls of said first segmented space by guides arms that are able to rock back and forth by mechanical elements. The device of this invention may be modular in nature such that a single unit may comprise one or more of each type of vehicular carriage.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

The invention claimed is:

1. A road paving device comprising at least three wheeled carriages wherein at least one of said three wheeled carriages having a motorized engine, said at least three wheeled carriages movable in tandem together in a linear direction, a first wheeled carriage having a container and an extraction element whereby pulverized and loosened asphalt material from the ground surface is pulled into its said container, an elevator system is disposed within the container of said first wheeled carriage, said elevator system is angled in an upward position towards a second wheeled carriage, an L-shaped platform containing a rotatable drum is positioned between the first and second wheeled carriage along their adjacent top surfaces, said second wheeled carriage having a container wherein said container comprises three segmented spaces, a first segmented space containing a series of pans extending laterally from the internal vertical wall surface of said container, each pan is slanted at a downward angle, said pans are positioned in opposite and alternating manner from each other along opposing vertical side surfaces of said first segmented space, each pan is attached to an agitator element that, when initiated, will cause each said pan to shake and agitate, an escalator element is positioned within a second segmented space, said escalator element is movable in an upward direction towards the top side of said third segmented space, said third segmented space of said second individual wheeled carriage containing at least three augers, each auger of said at least three augers extending along and parallel with the length of said third segmented space and parallel with each other, said third segmented space contains a conveyor platform positioned adjacently to said third wheeled carriage, said third-wheeled carriage having a container along its top side.

* * * * *